US010627091B2

(12) United States Patent
Gesell et al.

(10) Patent No.: US 10,627,091 B2
(45) Date of Patent: Apr. 21, 2020

(54) LIGHTING SYSTEM

(71) Applicant: OSRAM GmbH, Munich (DE)

(72) Inventors: Axel Gesell, Tegernheim (DE); Robert Kraus, Regensburg (DE); Andreas Hammer, Regensburg (DE)

(73) Assignee: OSRAM GMBH, Munich (DE)

( * ) Notice: Subject to any disclaimer, the term of this patent is extended or adjusted under 35 U.S.C. 154(b) by 536 days.

(21) Appl. No.: 14/784,612

(22) PCT Filed: Apr. 15, 2014

(86) PCT No.: PCT/EP2014/057674
§ 371 (c)(1),
(2) Date: Oct. 15, 2015

(87) PCT Pub. No.: WO2014/170349
PCT Pub. Date: Oct. 23, 2014

(65) Prior Publication Data

US 2016/0076749 A1 Mar. 17, 2016

(30) Foreign Application Priority Data

Apr. 15, 2013 (DE) ..... 10 2013 206 728

(51) Int. Cl.
*F21V 23/06* (2006.01)
*F21V 23/00* (2015.01)
(Continued)

(52) U.S. Cl.
CPC ..... *F21V 23/06* (2013.01); *F21V 19/003* (2013.01); *F21V 19/0025* (2013.01);
(Continued)

(58) Field of Classification Search
CPC .... F21V 23/06; F21V 19/0025; F21V 23/006; F21V 19/003; F21Y 2105/10; F21Y 2105/12; F21Y 2105/00; F21Y 2103/37
(Continued)

(56) References Cited

U.S. PATENT DOCUMENTS 3,040,169 A 6/1962 Lester
6,949,772 B2 * 9/2005 Shimizu ..... F21L 4/00 257/88
(Continued)

FOREIGN PATENT DOCUMENTS

DE 102009022401 A1 7/2010
DE 102009014535 A1 9/2010
(Continued)

OTHER PUBLICATIONS

European Office Action based on application No. 14 718 382.6 (5 pages) dated Nov. 28, 2016 (Reference Purpose Only)).
(Continued)

*Primary Examiner* — Harshad C Patel
(74) *Attorney, Agent, or Firm* — Viering, Jentschura & Partner MBB

(57) ABSTRACT

Various embodiments may relate to a lighting system, including at least one lighting module which has a printed circuit board and at least one lighting means arranged on the printed circuit board, and at least one electrical component for operating the lighting means of the lighting module. The electrical component is electrically connected to the lighting module. The electrical component is directly fastened to the lighting module.

10 Claims, 3 Drawing Sheets

(51) Int. Cl.

| | |
|---|---|
| ***F21V 19/00*** | (2006.01) |
| *F21Y 105/12* | (2016.01) |
| *F21Y 103/37* | (2016.01) |
| *F21Y 105/10* | (2016.01) |
| *F21Y 115/10* | (2016.01) |

(52) U.S. Cl.
CPC ..... *F21V 23/006* (2013.01); *F21Y 2103/37* (2016.08); *F21Y 2105/10* (2016.08); *F21Y 2105/12* (2016.08); *F21Y 2115/10* (2016.08)

(58) Field of Classification Search
USPC ..... 439/47; 362/612
See application file for complete search history.

(56) References Cited

U.S. PATENT DOCUMENTS

| | | | | |
|---|---|---|---|---|
| 7,824,070 | B2 * | 11/2010 | Higley | F21V 15/01 362/249.02 |
| 8,307,547 | B1 * | 11/2012 | Cobb | H05K 3/0052 29/592.1 |
| 2006/0256579 | A1 | 11/2006 | Yang et al. | |
| 2006/0285361 | A1 | 12/2006 | Cok | |
| 2007/0053173 | A1 * | 3/2007 | Faunce | F21V 33/006 362/95 |
| 2009/0120668 | A1 * | 5/2009 | Fjelstad | H01R 12/523 174/250 |
| 2010/0220046 | A1 | 9/2010 | Plötz et al. | |
| 2010/0265711 | A1 * | 10/2010 | Lee | H05K 1/142 362/249.06 |
| 2011/0222287 | A1 | 9/2011 | Lee | |
| 2012/0051052 | A1 | 3/2012 | Wagatsuma et al. | |
| 2012/0170261 | A1 * | 7/2012 | Hu | H01R 12/7076 362/217.16 |
| 2013/0088871 | A1 | 4/2013 | Yun et al. | |
| 2013/0229802 | A1 | 9/2013 | Fukushima et al. | |
| 2015/0198293 | A1 * | 7/2015 | Lankhorst | H05K 3/0052 362/235 |

FOREIGN PATENT DOCUMENTS

| | | | |
|---|---|---|---|
| DE | 102010039012 | A1 | 5/2012 |
| EP | 2613079 | A1 | 7/2013 |
| JP | 2005235779 | A | 9/2005 |
| TW | 366267 | U | 10/2009 |
| TW | 201229422 | A | 7/2012 |
| WO | 2010024507 | A1 | 3/2010 |
| WO | 2011075730 | A2 | 6/2011 |
| WO | 2012073543 | A1 | 6/2012 |

OTHER PUBLICATIONS

German Office Action based on application No. 10 2013 206 728.3 (5 pages) dated Nov. 28, 2013 (for reference purpose only).
International Search Report based on application No. PCT/EP2014/057674 (7 pages) dated Aug. 13, 2014 (for reference purpose only).
Chinese Office Action based on application No. 2014-80021983.5 (11 pages, no English translation) dated Nov. 3, 2017. (Reference Purpose only).

* cited by examiner

LIGHTING SYSTEM

RELATED APPLICATIONS

The present application is a national stage entry according to 35 U.S.C. § 371 of PCT application No.: PCT/EP2014/057674 filed on Apr. 15, 2014 which claims priority from German application No.: 10 2013 206 728.3 filed on Apr. 15, 2013, and is incorporated herein by reference in its entirety.

TECHNICAL FIELD

The disclosure relates to a lighting system.

BACKGROUND

A lighting system may have a lighting module which has a printed circuit board and at least one lighting means arranged on the printed circuit board. The lighting system may also have an electrical component which controls the lighting module and, in particular, the lighting means of the lighting module in order to operate them. The electrical component may be in the form of a ballast, for example.

Provision is usually made for the ballast to be arranged separately from the lighting module, for example by fastening the electrical component to a further printed circuit board arranged separately from the printed circuit board of the lighting module. The printed circuit board of the lighting module and the printed circuit board of the electrical component can then be fastened, for example, to a holder having elements, for example wires, which can be used to establish an electrical connection between the two printed circuit boards and therefore also between the lighting means and the electrical component. This results in complicated assembly since the lighting means first of all have to be mounted on the first printed circuit board and the electrical component has to be mounted on the second printed circuit board before an electrical connection can be established, for example by forming wiring, between the two printed circuit boards and therefore between the electrical component and the lighting means. In this case, it is necessary to ensure a sufficient mechanical and thermal connection by means of the fastening elements, for example a holder, and by means of the elements for forming the electrical connection. Furthermore, it is necessary to comply with safety requirements, such as provision of adequately dimensioned air gaps and leakage paths, by selecting special materials and using an additional housing and/or spacers.

SUMMARY

Various embodiments provide a lighting system which is distinguished by simplified assembly whilst complying with safety requirements.

In various embodiments, a lighting system may have: at least one lighting module which has a printed circuit board and at least one lighting means arranged on the printed circuit board, and at least one electrical component for operating the lighting means of the lighting module, wherein the electrical component is electrically connected to the lighting module, and wherein the electrical component is directly fastened to the lighting module.

Such a lighting system is distinguished by the fact that the electrical component is now directly fastened to the lighting module and is therefore arranged directly adjacent to the lighting module. In this case, "directly" means that no gap or clearance is formed between the lighting module and the electrical component, but rather the lighting module rests directly on an outer surface of the electrical component and is fastened thereto. The outer surface of the electrical component may be formed by a housing of the electrical component, with the result that the lighting module can be fastened to the housing, in particular to one or more side surfaces of the housing which form the outer surface, of the electrical component. The electrical component is in the form of a ballast, for example, which is used to control the one or more lighting means of the lighting module. The lighting means may be a light-emitting element. A light-emitting element may have one or more inorganic light-emitting diodes (LED) and/or one or more organic light-emitting diodes (OLED). Alternatively or additionally, the light-emitting element may have one or more laser diodes. The lighting means may be flat. The one or more lighting means are fastened to the printed circuit board of the lighting module, in which case the printed circuit board is used as a circuit carrier. The electrical component can be electrically connected to the lighting module via the printed circuit board of the lighting module by virtue of one or more contact elements being arranged on the printed circuit board, for example, which contact elements can be electrically connected to contact elements arranged on the electrical component. The lighting module and the electrical component can therefore be electrically connected directly without intermediate elements. The lighting system is distinguished by a reduced amount of assembly effort since the lighting module can be connected and fastened to the electrical component in one assembly step, in which case the safety requirements, in particular with respect to the air gaps and leakage paths, can be complied with. As a result of the fact that the electrical component is now no longer arranged at a distance from the lighting module, the lighting system may also have smaller dimensions than conventional lighting systems, with the result that a space-saving arrangement and assembly are possible. The amount of effort needed to establish an electrical connection between the electrical component and the lighting module can also be reduced since there is no longer any need for a complicated wiring arrangement.

In order to fasten the electrical component to the lighting module, the electrical component may have a groove, for example, in which the lighting module engages. The groove which is in the form of an elongate recess on the electrical component may be laterally formed on the electrical component, on the outer surface of the electrical component, for example the outer surface of the housing of the electrical component. The lighting module can engage in the groove in such a manner that an edge region of the printed circuit board of the lighting module is pushed into the groove. The groove enables a form-fitting connection between the electrical component and the lighting module. The electrical component can be assembled with the lighting module in a particularly simple and rapid manner here by pushing the lighting module with its printed circuit board into the groove formed on the electrical component, with the result that the lighting module is held and fixed in the groove.

As an alternative to providing a groove on the electrical component, in order to fasten the electrical component to the lighting module, the electrical component may have, on an outer surface of the electrical component, a step on which the lighting module is placed and fixed. The step may be in the form of a projection on the outer surface of the electrical component, for example the outer surface of the housing of the electrical component. The lighting module can be placed onto this step in such a manner that an edge region of the printed circuit board of the lighting module rests on the step. In order to fix the lighting module on the step, that edge region of the printed circuit board of the lighting module which rests on the step can be pressed against the step by applying a force, for example by means of a further element, to the printed circuit board in the direction of the step.

The electrical component may also be fastened to the lighting module by means of a fastening element. The electrical component can be fastened to the lighting module by the fastening element alone. However, it is also possible for the fastening element to be provided in addition to a groove or step formed on the electrical component. For example, the fastening element can be used to apply a force to the lighting module, for example the printed circuit board of the lighting module, if an edge region of the printed circuit board of the lighting module rests on the step, with the result that the fastening element can be used to fasten the lighting module resting on the step by pressing-on.

The fastening element may be in the form of a bracket or a clip, for example, which can partially engage around the electrical component, for example, in order to be able to fasten the lighting module to the electrical component. The bracket and the clip may be formed from a metal or plastic.

In order to form the electrical connection, the electrical component may be electrically connected to the lighting module via a plug connection. The plug connection may enable a rapid and simple electrical connection between the electrical component and the lighting module, thus making it possible to further reduce the amount of assembly effort for the lighting system. The plug connection and therefore the electrical connection can be formed at the same time as the lighting module is placed or pushed onto the electrical component. As a result, there is no longer any need to provide wirings by means of individual wires or else to provide cables. In addition, the plug connection makes it possible to quickly and easily release the electrical connection between the electrical component and the lighting module. The plug connection also makes it possible to mechanically and thermally connect the lighting module to the electrical component without having to provide further elements.

The plug connection may have a connector arranged on the electrical component and a mating connector which is arranged on the lighting module and can be connected to the connector. Contact elements which can make contact with one another by plugging together the connector and the mating connector may be arranged both in the connector and in the mating connector. In order to form the electrical connection between the lighting module and the electrical component, the connector can be electrically connected to, and can therefore make contact with, the mating connector in a simple manner.

Alternatively, it is also possible for the plug connection to have at least one spring contact element which is arranged on the electrical component and, in order to form the electrical connection, can be plugged into at least one metalized hole formed on the printed circuit board of the lighting module. When plugging a spring contact element into a metalized hole, electrical contact can be made between the spring contact element and the hole and therefore the printed circuit board of the lighting module. This plug connection is distinguished by a particularly space-saving configuration. The metallization of the hole can be formed by covering or coating the circumferential surface of the hole with a metal having particularly good electrical conductivity.

The electrical component may be fastened to a fastening surface, wherein the lighting module may be arranged at a distance from the fastening surface. Arranging the lighting module at a distance from the fastening surface makes it possible to comply with the required air gaps and leakage paths. The arrangement at a distance forms a clearance between the fastening surface and the lighting module, which clearance can be filled, for example, with a thermal insulator, for example air. With the configuration of the lighting system, it is thus possible to comply with the safety requirements with regard to the air gaps and leakage paths with a small amount of effort.

In order to achieve a particularly space-saving arrangement, the lighting module may be formed, for example, in such a manner that it at least partially engages around the electrical component. In this case, the lighting module may engage around the electrical component in such a manner that the electrical component is arranged in the center of the lighting module.

So that the lighting module at least partially engages around the electrical component, the printed circuit board of the lighting module may be U-shaped, for example. During assembly, the electrical component can be pushed into the recess in the U-shaped printed circuit board, with the result that the printed circuit board of the lighting module can engage around the electrical component on three side surfaces of the outer surface of the electrical component.

The object is also achieved by a lighting system having at least one first lighting module, in particular as described above, and a second lighting module, wherein both lighting modules each have at least one printed circuit board with a U-shaped recess, and wherein the lighting modules are formed in such a manner that at least one web of one of the two lighting modules, which delimits the at least one U-shaped recess, can be engaged in at least one U-shaped recess in the second lighting module or is changed to the assembled state, in particular.

This provides a compact lighting system which is able to be expanded in a modular manner. U-shaped or comb-like structures may be formed, in particular, in such a manner that they engage in one another such that virtually no intermediate spaces remain. This can be achieved in the case of three lighting modules by virtue of the webs of two outer lighting modules engaging in the recess in a module in between.

The first lighting module can be or is advantageously electrically connected to the second lighting module via a plug connection. This further simplifies the structure since the modules do not have to be soldered in a complicated manner.

It is expedient if at least one component of the plug connection can also be used as a component of a plug connection to an electrical component as described above. This ensures universal usability of the module since it can be connected both to an electrical component and to other modules.

It is also expedient if the plug connection has a connector arranged on the first lighting module and a mating connector which is arranged on the second lighting module and can be connected to the connector. This makes it possible to easily connect the modules to one another. As above, the plug connection is preferably formed when connecting the electrical component and the lighting module.

BRIEF DESCRIPTION OF THE DRAWING

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following detailed description, reference is made to the accompanying drawings which form part of this description and show, for illustration purposes, specific embodiments in which the invention can be implemented. In this regard, direction terminology such as, for instance, "at the top", "at the bottom", "at the front", "at the back", "front", "rear", etc., is used with reference to the orientation of the figure(s) described. Since components of embodiments can be positioned in a number of different orientations, the direction terminology serves for illustration purposes and is not restrictive in any way at all. It goes without saying that other embodiments can be used and structural or logical changes can be made, without departing from the scope of protection of the present invention. It goes without saying that the features of the various exemplary embodiments described herein can be combined with one another, unless specifically indicated otherwise. The following detailed description should therefore not be interpreted in a restrictive sense, and the scope of protection of the present invention is defined by the appended claims.

In the context of this description, the terms "linked", "connected" and "coupled" are used to describe both a direct and an indirect link, a direct or indirect connection and direct or indirect coupling. In the figures, identical or similar elements are provided with identical reference symbols insofar as this is expedient.

Figure 1:
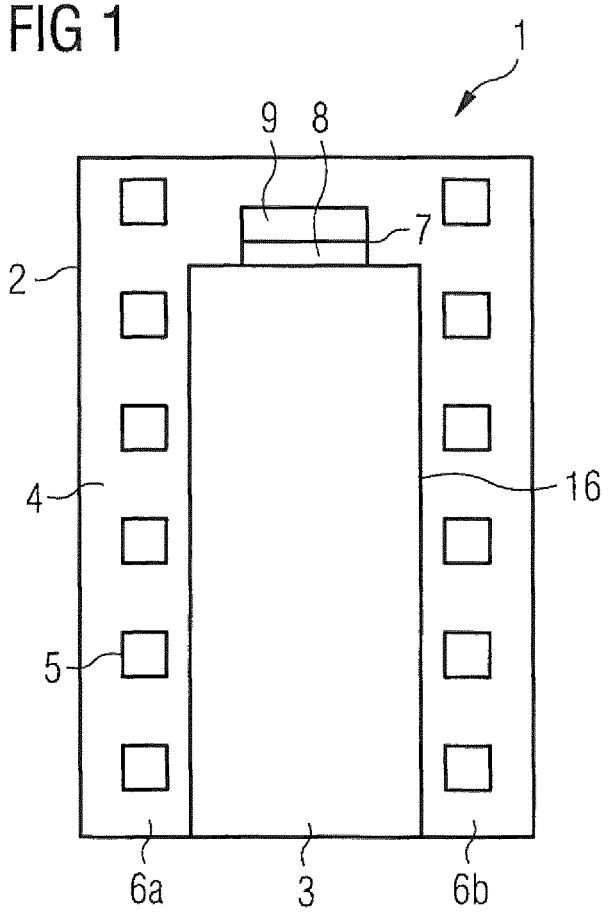
FIG. 1 shows a schematic illustration of a plan view of a lighting system according to one embodiment.

FIG. 1 shows a lighting system 1 which has a lighting module 2 and an electrical component 3. The lighting module 2 has a printed circuit board 4 and a plurality of lighting means 5, the lighting means 5 being arranged on the printed circuit board 4. The lighting means 5 which may be in the form of a light-emitting diode (LED) are arranged here parallel to one another in two rows. The printed circuit board 4 is U-shaped, with the electrical component 3 which may be in the form of a ballast being arranged between two parallel webs 6*a*, 6*b* of the U-shaped printed circuit board 4. The electrical component 3 is therefore arranged substantially in the center of the lighting module 2, with the result that the lighting module 2 or the printed circuit board 4 of the lighting module 2 at least partially engages around the electrical component 3, here on three side surfaces 16. The electrical component 3 is directly fastened to the printed circuit board 4 of the lighting module 2, with the result that no clearance is formed between the electrical component 3 and the lighting module 2.

The electrical component 3 which is rectangular or box-shaped here is used to operate or control the lighting means 5 arranged on the printed circuit board 4. For this purpose, the electrical component 3 is electrically connected to the lighting module 2, with the electrical connection being formed by means of a plug connection 7. The plug connection 7 has a connector 8 arranged on the electrical component 3 and a mating connector 9 fastened to the printed circuit board 4 of the lighting module 2, wherein, in order to make electrical contact, the connector 8 is connected to the mating connector 9, as shown in FIG. 1. When fastening the electrical component 3 to the lighting module 2 by pushing the electrical component into the recess in the U-shaped printed circuit board 4 formed by the two webs 6*a*, 6*b*, for example, the connector 8 can be quickly and easily connected to the mating connector 9. The plug connection means that there is no longer any need to provide wirings to be arranged in a complicated manner.

Figure 2:
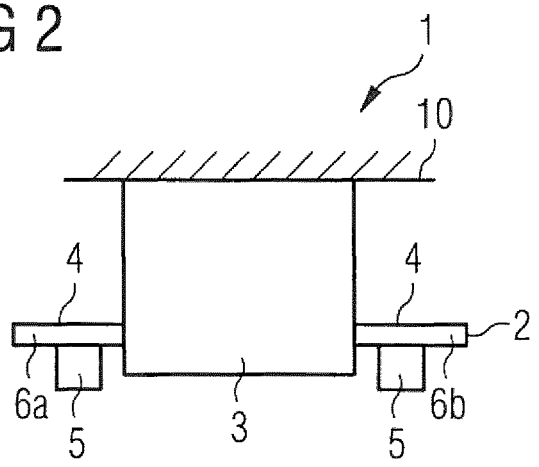
FIG. 2 shows a schematic illustration of a side view of the lighting system shown in FIG. 1.

FIG. 2 shows a side view of the lighting system 1 shown in FIG. 1, in which case it can be seen here that the electrical component 3 is arranged between the two webs 6*a*, 6*b* of the board-shaped printed circuit board 4 of the lighting module 2 and is therefore at least partially engaged around.

The electrical component 3 is arranged or fastened on a fastening surface 10. The printed circuit board 4 of the lighting module 2 extends parallel to the fastening surface 10, a distance being provided between the printed circuit board 4 and the fastening surface 10, with the result that the lighting module 2 is positioned at a distance from the fastening surface 10. A clearance is therefore formed between the fastening surface 10 and the lighting module 2, which clearance is filled with air, for example, and therefore has an insulating effect, thus complying with the requirements imposed on air gaps and leakage paths.

Figure 3:
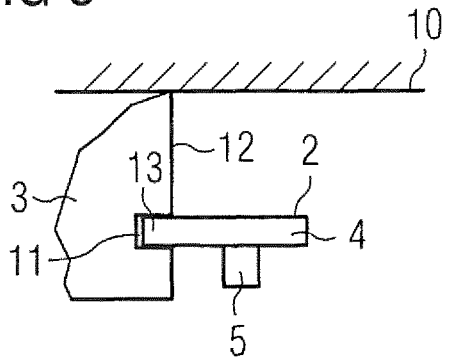
FIG. 3 shows a schematic detailed illustration of a fastening of the lighting system shown in FIG. 1.
Figure 4:
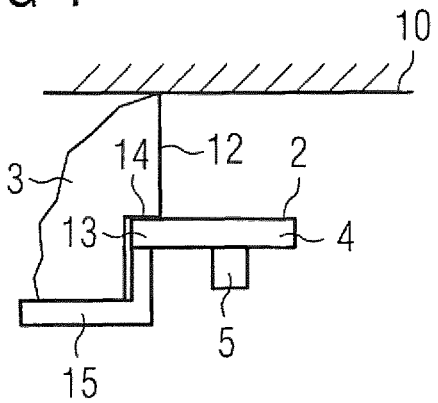
FIG. 4 shows a further schematic detailed illustration of a fastening of the lighting system shown in FIG. 1.
Figure 5:
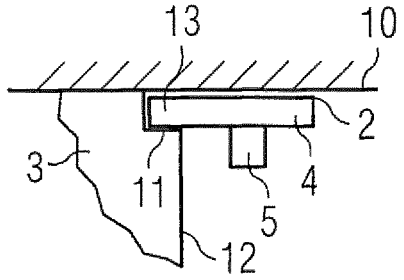
FIG. 5 shows a further schematic detailed illustration of a fastening of the lighting system shown in FIG. 1.

FIGS. 3-5 show different ways of possibly fastening the electrical component 3 to the lighting module 2.

In the case of the fastening shown in FIG. 3, a groove 11 in the form of a recess formed on the outer surface 12 of the electrical component 3 is formed on the electrical component 3. The groove 11 may be formed circumferentially on the side surfaces of the outer surface 12 of the electrical component 3, on which the U-shaped printed circuit board 4 of the lighting module 2 adjoins the electrical component 3. An edge region 13 of the printed circuit board 4 of the lighting module 2 is introduced into the groove 11 and is held and fixed in the groove 11. The groove 11 enables a form-fitting connection between the electrical component 3 and the lighting module 2.

In the case of the fastening shown in FIG. 4, a step 14 is formed on the outer surface 12 of the electrical component 3, on which step an edge region 13 of the printed circuit board 4 of the lighting module 2 is placed and fixed. The step 14 is formed on the side surfaces of the outer surface 12 of the electrical component 3, on which the lighting module 2 adjoins the electrical component 3.

In order to fix the printed circuit board 4 of the lighting module 2, which rests on the step 14, a fastening element 15 in the form of a bracket or a clip is arranged on the electrical component 3, which presses the printed circuit board 4 or the edge region 13 of the printed circuit board 4 against the step 14.

In the case of the fastening shown in FIG. 5, a step 14 is also formed on the outer surface 12 of the electrical component 3, on which step an edge region 13 of the printed circuit board 4 of the lighting module 2 rests. In the configuration shown in FIG. 5, the lighting module 2 adjoins the fastening surface 10, with the result that the printed circuit board 4 is pressed against the step 14 here by means of the fastening surface 10 and is therefore fixed to the electrical component 3.

Figure 6:
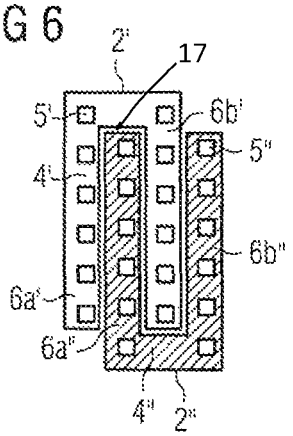
FIG. 6 shows a schematic illustration of an arrangement of a plurality of lighting modules.

FIG. 6 shows an arrangement of a plurality of, here two, lighting modules 2', 2", for example when producing lighting modules 2', 2" for lighting systems 1. Both lighting modules 2', 2" each have a U-shaped printed circuit board 4', 4". The printed circuit board 4' of the first lighting module 2' has two webs 6*a*', 6*b*' which delimit a recess in the printed circuit board 4', and the printed circuit board 4" of the second lighting module 2" has two webs 6*a*", 6*b*" which delimit a recess in the printed circuit board 4". The two lighting modules 2', 2" engage in one another in such a manner that the first web 6*a*" of the printed circuit board 4" of the second lighting module 2" engages in the recess in the printed circuit board 4' of the first lighting module 2' and the second web 6*b*' of the printed circuit board 4' of the first lighting module 2' engages in the recess in the printed circuit board 4" of the second lighting module 2", as a result of which it is possible to efficiently use the area when producing lighting modules 2, 2', 2" or lighting systems 1. In comparison with area light sources, virtually double use of the useful area (lighting means/unit area) is possible in the arrangement shown in FIG. 6 and also in the arrangements shown in FIG. 7 and FIG. 8.

The first lighting module 2' can be or is advantageously electrically connected to the second lighting module 2" via a plug connection 7. This further simplifies the structure since the modules do not have to be soldered in a complicated manner.

It is expedient if at least one component 9 of the plug connection 7 can also be used as a component 9 of a plug connection 8 to an electrical component 3 as described above. This ensures universal usability of the module since it can be connected both to an electrical component 3 and to other modules.

It is also expedient if the plug connection 7 has a connector 9 arranged on the first lighting module 2' and a mating connector 17 which is arranged on the second lighting module 2" and can be connected to the connector 9. This makes it possible to easily connect the modules to one another. As above, the plug connection 7 is preferably formed when connecting the electrical component 3 and the lighting module 2.

Figure 7:
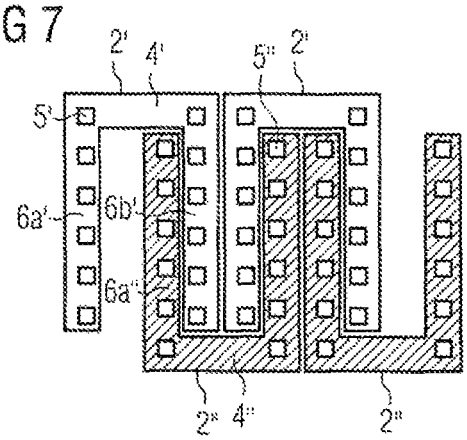
FIG. 7 shows a further schematic illustration of an arrangement of a plurality of lighting modules.

FIG. 7 shows an arrangement in which the distance between the webs 6*a*', 6*b*' and therefore the recess in a U-shaped printed circuit board 4' is greater, with the result that two webs 6*a*", 6*b*" of printed circuit boards 4" of further lighting modules 2" can engage in the recess. In comparison with the arrangement shown in FIG. 6, two first lighting modules 2' and two second lighting modules 2" which engage in one another are provided in the arrangement shown in FIG. 7.

Figure 8:
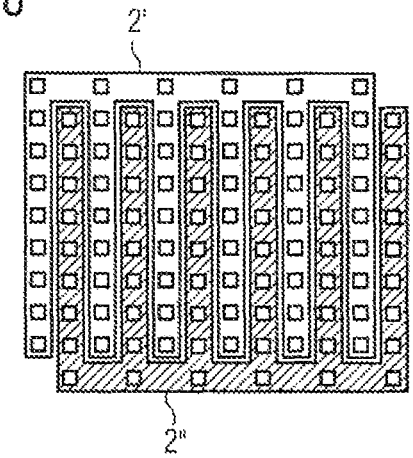
FIG. 8 shows a further schematic illustration of an arrangement of a plurality of lighting modules.

In the possible arrangement shown in FIG. 8, a first lighting module 2' and a second lighting module 2" which are each comb-like and engage in one another in a comb-like manner are provided. This shows that lighting modules 2, 2', 2" are also possible in which the printed circuit boards 4, 4', 4" have a plurality of fingers which may be arranged on a common connecting web, thus making it possible to make particularly good use of the useful area when producing the printed circuit boards 4, 4', 4" and therefore the lighting modules 2, 2', 2" or lighting systems 1.

In the possible configurations of a lighting system 1 and a possible arrangement of lighting modules 2, 2', 2" when producing lighting systems 1, as shown in FIGS. 1-8, the total amount of effort needed to assemble the lighting system 1 is reduced and effective use of the area is possible. In this case, the assembly can be carried out in such a manner that one or more lighting modules 2, 2', 2" are first of all connected to an electrical component 3 and are fastened to the latter and the electrical component 3 is then fastened, together with the lighting modules 2, 2', 2", to the fastening surface 10. Alternatively, it is also possible for the electrical component 3 to first be fastened to the fastening surface 10 and then for one or more lighting modules 2, 2', 2" to be fastened to the electrical component 3.

The invention claimed is:

1. A lighting system, comprising:

at least one lighting module which has a printed circuit board and at least one light-emitting element arranged on the printed circuit board, and at least one electrical component for operating the light-emitting element of the lighting module, wherein the electrical component is electrically connected to the lighting module, and wherein the electrical component is directly fastened to the lighting module, wherein there is no gap between the lighting module and the electrical component.

2. The lighting system as claimed in claim 1, wherein the electrical component has a groove to engage with the lighting module.

3. The lighting system as claimed in claim 1, wherein the electrical component has a step on an outer surface of the electrical component, on which the lighting module is placed and fixed.

4. The lighting system as claimed in claim 1, wherein the electrical component is fastened to the lighting module by a fastening element at least partially engaged around the electrical component.

5. The lighting system as claimed in claim 4, wherein the fastening element is in the form of a bracket or a clip.

6. The lighting system as claimed in claim 1, wherein the electrical component is electrically connected to the lighting module via a plug connection.

7. The lighting system as claimed in claim 6, wherein the plug connection has a connector arranged on the electrical component and a mating connector which is arranged on the lighting module and is connected to the connector.

8. The lighting system as claimed in claim 1, further comprising a fastening surface, wherein the electrical component is fastened to the fastening surface, wherein the lighting module is arranged at a distance from the fastening surface.

9. The lighting system as claimed in claim 1, wherein the lighting module is formed in such a manner that it at least partially engages around the electrical component.

10. The lighting system as claimed in claim 1, wherein the printed circuit board of the lighting module is U-shaped.

* * * * *